US005519310A

United States Patent [19]

Bartlett

[11] Patent Number: 5,519,310

[45] Date of Patent: May 21, 1996

[54] VOLTAGE-TO-CURRENT CONVERTER WITHOUT SERIES SENSING RESISTOR

[75] Inventor: Donald M. Bartlett, Ft. Collins, Colo.

[73] Assignees: AT&T Global Information Solutions Company, Dayton, Ohio; Hyundai Electronics America, Milpitas, Calif.; Symbios Logic Inc., Fort Collins, Colo.

[21] Appl. No.: 125,267

[22] Filed: Sep. 23, 1993

[51] Int. Cl.[6] ..... G05F 3/16

[52] U.S. Cl. ..... 323/316; 327/538; 330/288

[58] Field of Search ..... 323/312, 315, 323/316; 327/530, 538, 539; 330/252, 257, 288

[56] References Cited

U.S. PATENT DOCUMENTS

| | | | |
|---|---|---|---|
| 4,399,399 | 8/1983 | Joseph | 323/315 |
| 4,553,084 | 11/1985 | Wrathall | 323/316 |
| 4,651,083 | 3/1987 | Lachmann et al. | 323/316 |
| 4,820,968 | 4/1989 | Wrathall | 323/316 |
| 4,853,609 | 8/1989 | Numata et al. | 323/312 |
| 4,885,477 | 12/1989 | Bird et al. | 307/296.8 |
| 4,906,915 | 3/1990 | Abdi | 323/316 |
| 4,965,510 | 10/1990 | Kriedt et al. | 323/315 |
| 4,990,845 | 2/1991 | Gord | 323/312 |
| 5,021,730 | 6/1991 | Smith | 323/316 |
| 5,107,199 | 4/1992 | Vo et al. | 323/316 |

*Primary Examiner*—Peter S. Wong
*Assistant Examiner*—Y. Jessica Han
*Attorney, Agent, or Firm*—Wayne P. Bailey; James M. Stover

[57] ABSTRACT

A voltage controlled current source including feedback circuitry which eliminates the need for a current sensing resistor in series with the output voltage controlled current source. The feedback circuit includes circuitry for generating a reference current which is proportional to, but much smaller than, the output current produced by the current source, and current mirror circuitry for generating a sense current which is equivalent to the reference current. The sense current is provided to a current sense resistor, across which a feedback voltage is developed. The voltage controlled current source further includes an amplifier connected to receive an input control voltage and the feedback voltage for generating the output current in response to the input control voltage and the feedback voltage.

15 Claims, 2 Drawing Sheets

PRIOR ART

VOLTAGE-TO-CURRENT CONVERTER WITHOUT SERIES SENSING RESISTOR

The present invention relates to feedback circuits and, more particularly, to voltage-to-current converters employing feedback sense resistors.

BACKGROUND OF THE INVENTION

The use of negative feedback in an electronic circuit generally produces changes in the characteristics of the circuit that improve the performance of the circuit. Negative feedback may be employed within an amplifier circuit to produce more uniform amplification, to stabilize the gain of the circuit against changes in temperature or component replacement, to control input and output impedances or to reduce noise or interference in the amplifier.

Feedback can be introduced into an amplifier by providing to the input of the amplifier a fraction of the amplifier output. A block diagram of a classical amplifier circuit including negative feedback is illustrated in FIG. 1. The amplifier circuit includes an amplifier 12, a feedback circuit 14, and a summing junction 10. The input signal, identified as $X_{IN}$, is received by summing junction 10, combined with the output of feedback circuit 14 and provided to amplifier 12. The output of the amplifier circuit, identified as $X_{OUT}$, is:

$$X_{OUT}=A(X_{IN}-\beta X_{OUT}); \qquad \text{EQN 1}$$

where:

A = the gain of amplifier 12; and

β = the gain of feedback circuit 14.

The transfer characteristic, often referred to as the feedback gain $A_f$, of the amplifier circuit is:

$$A_f=X_{OUT}/X_{IN}=A/(1+A\beta). \qquad \text{EQN 2}$$

In the limiting case, as A becomes very large, the transfer characteristic can be approximated by the following equation:

$$A_f=1/\beta. \qquad \text{EQN 3}$$

In the above equations the input and output signals, $X_{IN}$ and $X_{OUT}$, respectively, can be either voltage or current signals. An amplifier which converts an input voltage signal into an output current signal is known as a voltage-to-current converter. Voltage-to-current converters may be utilized within drives for DC brushless motors or voice coil type motors, such as are employed in computer disk drives.

A typical voltage-to-current converter, also known as a voltage-controlled current source, built with standard analog components is shown in FIG. 2. The converter includes an operational amplifier OA the output of which is connected to the gate terminal of an N-channel MOSFET transistor M. A voltage input signal $V_{IN}$ is provided to the non-inverting input (+) of operational amplifier OA and a feedback voltage signal $V_F$ is provided to the inverting (−) input of operational amplifier OA. The drain terminal of transistor M is connected through a load (not shown) to a first reference voltage source $V_{DD}$ and the source terminal of transistor M is connected through a current sensing resistor having a resistance of R to a second reference voltage source $V_{SS}$. The output current generated by the converter is identified as $I_{OUT}$. The voltage developed across the current sensing resistor is provided to the negative input of operational amplifier OA as the feedback voltage signal $V_F$. The feedback factor or gain, β, for the feedback function for the circuit shown in FIG. 2 is R ($V_F=I_{OUT}*R$).

The transfer function for the voltage-to-current converter, developed from EQN 2 by replacing β with R, $X_{OUT}$ with $I_{OUT}$ and $X_{IN}$ with $V_{IN}$, is therefore:

$$I_{OUT}=V_{IN}/R \qquad \text{EQN 4}$$

As stated above, feedback is provided to the operational amplifier by incorporating a current sensing resistor in series with the load and sensing the voltage developed across the sense resistor. Unfortunately, placing a sensing resistor in series with the output limits the compliance voltage of the converter, i.e. the voltage drop required to be developed across the current source in order to provide a current at the output of the current source. The sense resistor is also a source of power dissipation which is not attributable to the load.

OBJECTS OF THE INVENTION

It is therefore an object of the present invention to provide a new and useful voltage-to-current converter which overcomes the above-mentioned problems of prior art voltage-to-current converters.

It is another object of the present invention to provide a new and useful current sensing circuit for sensing the output current of a voltage-to-current converter without the utilization of a sense resistor in series with the converter load.

It is an additional object of the present invention to provide such a current sensing circuit which includes unique current mirror circuitry for developing a feedback signal for the converter.

It is yet another object of the present invention to provide such a a current sensing circuit which includes comparing means for assuring a proportional relationship between the current flow through the current mirror circuitry and the output current flow generated by the converter.

SUMMARY OF THE INVENTION

There is provided, in accordance with the present invention, a voltage controlled current source comprising an output current carrying section; a reference current carrying section connected in parallel with the output current carrying section for producing a reference current which is proportional to the output current flowing through the output current carrying section; a current mirror circuit connected to the reference current carrying section and including an output providing a current which is proportional to the reference current flowing through the reference current carrying section; a current sense resistor connected to the output of the current mirror circuit across which a feedback voltage is developed; and amplifier means connected to receive an input control voltage and the feedback voltage and connected to the output current carrying section for controlling the current flowing through the output carrying section in response to the input control voltage and the feedback voltage.

In the described embodiment, the amplifier means comprises a first operational amplifier having a non-inverting input connected to receive said input control voltage, an inverting input connected to receive said feedback voltage, and an output; and a first N-channel field effect transistor (FET) having a gate terminal connected to the output of the operational amplifier, a source terminal connected to a first reference voltage source, and a drain terminal for providing the output current. The output current carrying section comprises the first reference voltage source and the transistor.

The reference current carrying section comprises a second N-channel FET having a gate terminal connected to the output of the first operational amplifier, a source terminal connected to the first reference voltage source, and a drain terminal; a second operational amplifier having a non-inverting input connected to the drain terminal of the first N-channel FET, an inverting input, and an output; a third N-channel FET having a gate terminal connected to the output of the second operational amplifier, a source terminal connected to the drain terminal of the second N-channel FET, and a drain terminal connected to the current mirror circuit; and a feedback connection coupling the drain terminal of the second N-channel FET with the inverting input of the second operational amplifier.

The current mirror circuit comprises a first P-type FET having a gate terminal, a source terminal connected to a second reference voltage source, and a drain terminal connected to the drain terminal of the third N-channel FET; and a second P-channel FET having a gate terminal connected to the control and source terminals of the first P-channel FET, a source terminal connected to the second reference voltage source, and a drain terminal connected to the current sense resistor. The current sense resistor is connected between the drain terminal of the second P-channel FET transistor and the first reference voltage source.

The channel width to length ratios for the first and second N-channel FETs are selected so that the reference current flow through the second N-channel FET is proportional to and substantially smaller than the output current flow through the first P-channel FET. The first and second P-channel FETs are substantially identical such that the current flow through the second P-channel FET is equivalent to the reference current flow through the first N-channel FET.

The above and other objects, features, and advantages of the present invention will become apparent from the following description and the attached drawings.

DETAILED DESCRIPTION OF THE PREFERRED EMBODIMENT

Figure 3:
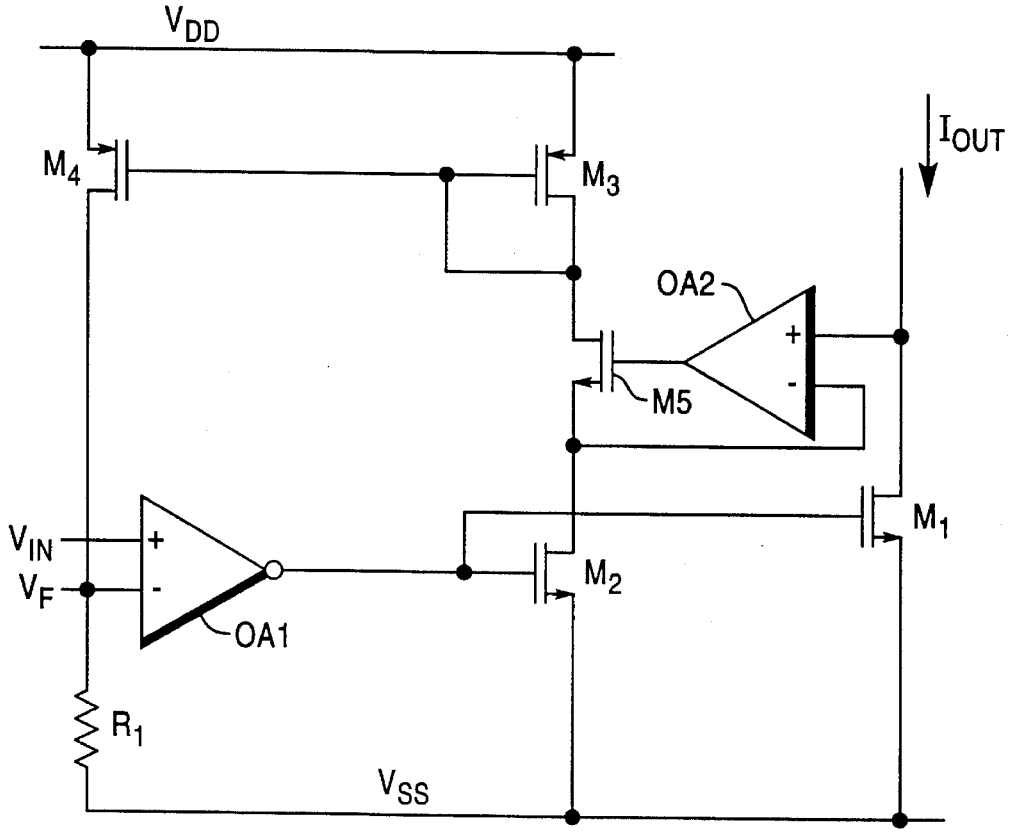
FIG. 3 is a schematic diagram of a voltage-to-current converter in accordance with the present invention.

Referring now to FIG. 3, a schematic diagram of a voltage-to-current converter representing a preferred embodiment of the present invention is illustrated. The converter includes an operational amplifier OA1 the output of which is connected to the gate terminal of an N-channel MOSFET transistor M1. A voltage input signal $V_{IN}$ is provided to the non-inverting (+) input of operational amplifier OA1 and a feedback voltage signal $V_F$ is provided to the inverting (–) input of operational amplifier OA1. The source terminal of transistor M1 is connected to a first reference voltage source $V_{SS}$ and the drain terminal of transistor M1 is connected through a load (not shown) to a second reference voltage source $V_{DD}$. The output current generated by the converter is identified as $I_{OUT}$.

The feedback voltage signal is generated by a feedback circuit which includes a second operational amplifier OA2, four additional transistors, M2 through M5, and a current sensing resistor. N-channel transistor M2 is connected to operate in parallel with transistor M1, both transistors having their gate terminals connected to the output of operational amplifier OA1 and their source terminals connected to reference voltage source $V_{SS}$. Operational amplifier OA2 and N-channel source follower transistor M5 are connected between transistors M1 and M2 so as to force the voltage on the drain of transistor M2 to match the voltage at the drain of transistor M1. Operational amplifier OA2 has its non-inverting (+) input connected to the drain of transistor M1, its inverting (–) input connected to the drain of transistor M2 and its output connected to the gate terminal of transistor M5, which is connected in series with transistor M2.

Constructed as described above, the current flow through transistor M2 will be proportional to the current flow through transistor M1, $IOU_T$. The magnitude of the current flow through M2 can be controlled by ratioing the channel width-to-length (W/L) of the two transistors. For example, if transistors M1 and M2 are identical transistors except for the ratios of their channels width to length, transistor M2 has a W/L ratio of 10/2 and transistor M1 has a W/L ratio of 1000/2, then the current flow through transistor M2 will be 1/100 of $I_{OUT}$.

The two P-channel MOSFET transistors M3 and M4 are connected to form a current mirror circuit. Transistors M3 and M4 each have their source terminals connected to reference voltage source $V_{DD}$. The gate terminal of transistor M3 is connected to its drain terminal which is further connected to the drain terminal of transistor M5 to form the input to the current mirror circuit. The gate terminal of transistor M4 is connected to the gate and drain terminals of transistor M3. The drain terminal of transistor M4 forms the output of the current mirror circuit and is connected through the current sensing resistor to reference voltage source $V_{SS}$. The channel width-to-length ratios of transistors M3 and M4 are equivalent so that the current input and current output of the current mirror circuit are constrained to be equal.

The voltage generated across the current sensing resistor is provided to the inverting (–) input of operational amplifier OA2 as the feedback voltage signal $V_F$. The feedback factor or gain, β, for the feedback function for the circuit shown in FIG. 3 is R1(W2/L2)/(W1/L1), where R1 is the resistance of the current sensing resistor, W2/L2 is the channel width to length ratio of transistor M2, and W1/L1 is the channel width to length ration of transistor M1. The transfer function for the voltage-to-current converter of FIG. 3, developed from EQN 2 by replacing β with R1(W2/L2)/(W1/L1), $X_{OUT}$ with $I_{OUT}$ and $X_{IN}$ with $V_{IN}$, is therefore:

$$I_{OUT}=V_{IN}(W1/L1)/R1(W2/L2) \qquad \text{EQN 5}$$

Figure 1:
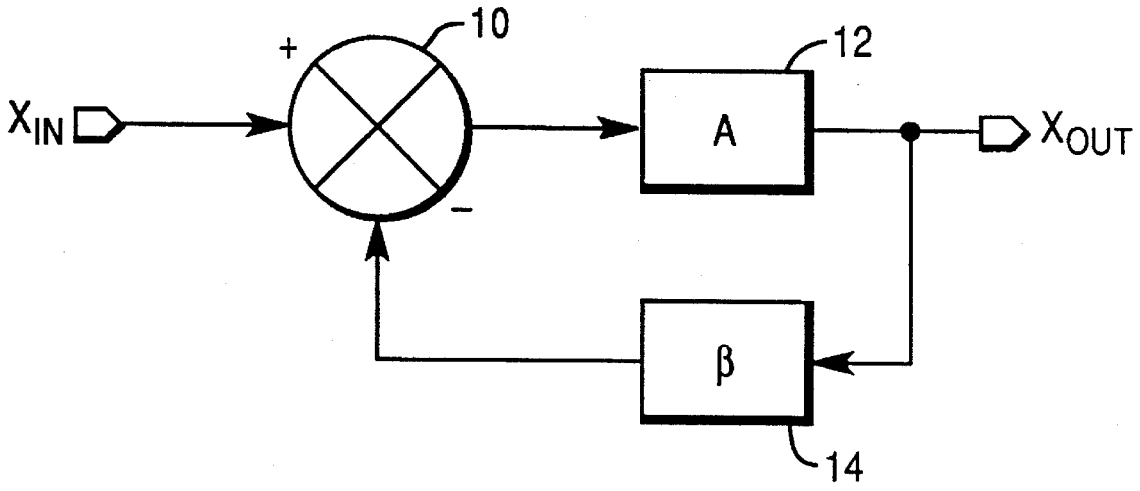
FIG. 1 is a block diagram of a classical feedback circuit.
Figure 2:
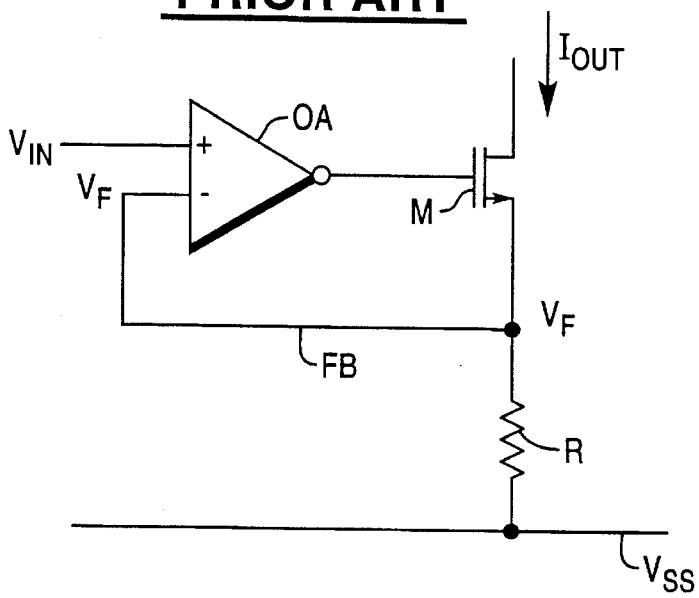
FIG. 2 PRIOR ART
FIG. 2 is a schematic circuit diagram of a prior art voltage-to-current converter including a current sensing resistor in series with the converter load to provide negative feedback.

To provide the same output signal $I_{OUT}$ and voltage feedback signal $V_F$ from the same input signal $V_{IN}$ as the prior art circuit of FIG. 2, the resistance value R1 in the circuit of FIG. 3 must be selected to be (W1/L1)R/(W2/L2). Continuing with the example set forth above wherein transistor M2 has a W/L ratio of 10/2 and transistor M1 has a W/L ratio of 1000/2, the resistance R1 would be set to 100 R. Although the resistance of the current sensing resistor will be increased by the factor of (W1/L1)/(W2/L2), the power dissipated by the resistor will be decreased by (W1/L1)/(W2/L2) due to the reduced current flow through the current sensing resistor. Again continuing with the example above, the power dissipated in the resistor of FIG. 3 would be 1/100th of the power dissipated in the resistor of FIG. 2.

It can thus be seen that there has been provided by the present invention a voltage to current converter design which eliminates the problems associated with having a current sensing resistor in series with the converter load. The feedback circuit design which includes current mirroring, comparing means for assuring a proportional relationship between the current flow through the current mirror circuitry and the output current flow generated by the converter, and a current sensing resistor connected to the current mirror circuitry is not limited to application within a voltage to current converter. The feedback circuit design and aspects thereof may find utility in other closed-loop amplifier applications.

Although the presently preferred embodiment of the invention has been described, it will be understood that various changes may be made within the scope of the appended claims.

What is claimed is:

1. A voltage controlled current source comprising:

an output current carrying section;

a reference current carrying section connected in parallel with said output current carrying section for producing a reference current which is proportional to an output current flowing through said output current carrying section;

a current mirror circuit connected to said reference current carrying section and including an output providing a current which is proportional to the current flowing through said reference current carrying section;

a current sense resistor connected to the output of said current mirror circuit across which a feedback voltage is developed; and amplifier means connected to receive an input control voltage and said feedback voltage and connected to said output current carrying section for controlling the current flowing through said output carrying section in response to said input control voltage and said feedback voltage.

2. The voltage controlled current source in accordance with claim 1, wherein:

said amplifier means comprises:

a first operational amplifier having a non-inverting input connected to receive said input control voltage, an inverting input connected to receive said feedback voltage, and an output; and a first transistor having a control terminal connected to the output of said operational amplifier, a first terminal connected to a first reference voltage source, and a second terminal for providing said output current; and said output current carrying section comprises said first reference voltage source and said transistor.

3. The voltage controlled current source in accordance with claim 2, wherein said reference current carrying section comprises:

a second transistor having a control terminal connected to the output of said first operational amplifier, a first terminal connected to said first reference voltage source, and a second terminal; and voltage control means connecting the second terminal of said first and second transistors for causing the voltage potential at the second terminal of said second transistor to be substantially equal to the voltage potential at the second terminal of said first transistor.

4. The voltage controlled current source in accordance with claim 3, wherein said first and second transistors comprise first and second N-channel field effect transistors (FETs), respectively, said control terminals being the gate terminals of said N-channel FETs, said first terminals being the source terminals of said N-channel FETs, and said second terminals being the drain terminals of said N-channel FETs.

5. The voltage controlled current source in accordance with claim 4, wherein:

said first N-channel FET has a first channel width to length ratio;

said second N-channel FET has a second channel width to length ratio differing from said first channel width to length ratio so that the reference current flow through said second N-channel FET is proportional to and substantially smaller than the output current flow through said first N-channel FET.

6. The voltage controlled current source in accordance with claim 5, wherein:

said first and second N-channel FETs are formed together in a single semiconductor and are substantially identical except for their channel width to length ratios.

7. The voltage controlled current source in accordance with claim 3, wherein said voltage control means comprises:

means for comparing the voltages at the second terminals of said first and second transistors; and means for controlling the reference current flow through said second transistor in response to an output of said comparing means such that the voltage potential at the second terminal of said second transistor is maintained substantially equal to the voltage potential at the second terminal of said first transistor.

8. The voltage controlled current source in accordance with claim 3, wherein said voltage control means comprises:

a second operational amplifier having a non-inverting input connected to the second terminal of said first transistor, an inverting input, and an output;

a third transistor having a control terminal connected to the output of said second operational amplifier, a first terminal connected to the second terminal of said second transistor, and a second terminal connected to said current mirror circuit; and a feedback connection coupling the second terminal of said second transistor with the inverting input of said second operational amplifier.

9. The voltage controlled current source in accordance with claim 8, wherein said current mirror circuit comprises:

a fourth transistor having a control terminal, a first terminal connected to a second reference voltage source, and a second terminal connected to the second terminal of said third transistor; and a fifth transistor having a control terminal connected to the control and first terminals of said fourth transistor, a first terminal connected to said second reference voltage source, and a second terminal connected to said current sense resistor.

10. The voltage controlled current source in accordance with claim 9, wherein:

said current sense resistor is connected between the second terminal of said fifth transistor and said first reference voltage source; and the inverting input of said first operational amplifier is connected to the second terminal of said fifth transistor.

11. The voltage controlled current source in accordance with claim 10, wherein:

said third transistor comprises a third N-channel field effect transistors (FET), said control terminal of said third transistor being the gate terminal of said third N-channel FET, said first terminal of said third transistor being the source terminal of said third N-channel FET, and said second terminal of said third being the drain terminal of said third N-channel FET;

said fourth and fifth transistors comprise first and second P-channel field effect transistors (FETs), respectively, said control terminals of said fourth and fifth transistors being the gate terminals of said P-channel FETs, said first terminals of said fourth and fifth transistors being the source terminals of said P-channel FETs, and said second terminals of said fourth and fifth transistors being the drain terminals of said P-channel FETs.

12. The voltage controlled current source in accordance with claim 11, wherein:

said first and second P-channel FETs are substantially identical such that the current flow through said second P-channel FET is equivalent to the reference current flow through said first P-channel FET.

13. A feedback circuit for a voltage controlled current source, said feedback circuit comprising:

a reference current carrying section for producing a current which is proportional to the current flow generated by said current source;

a current mirror circuit connected to said reference current carrying section and including an output providing a current which is proportional to the current flowing through said reference current carrying section; and a current sense resistor connected to the output of said current mirror circuit across which a feedback voltage potential is developed.

14. A closed loop feedback amplifier system comprising:

a first operational amplifier having a non-inverting input connected to receive an input control voltage, an inverting input connected to receive a feedback voltage, and an output;

a first transistor having a control terminal connected to the output of said operational amplifier, a first terminal connected to a first reference voltage source, and a second terminal for providing an output current;

a second transistor having a control terminal connected to the output of said first operational amplifier, a first terminal connected to said first reference voltage source, and a second terminal;

voltage control means connecting the second terminal of said first and second transistors for causing the voltage potential at the second terminal of said second transistor to be substantially equal to the voltage potential at the second terminal of said first transistor;

a third transistor having a control terminal, a first terminal connected to a second reference voltage source, and a second terminal connected in series with said second transistor;

a fourth transistor having a control terminal connected to the control and second terminals of said third transistor, a first terminal connected to said second reference voltage source, and a second terminal; and a current sense resistor connected between the second terminal of said fourth transistor and said first reference voltage source for generating said feedback voltage, the inverting input of said first operational amplifier being connected to the second terminal of said fourth transistor.

15. The closed loop feedback amplifier system in accordance with claim 14, wherein said voltage control means comprises:

a second operational amplifier having a non-inverting input connected to the second terminal of said first transistor, an inverting input, and an output;

a fifth transistor having a control terminal connected to the output of said second operational amplifier, a first terminal connected to the second terminal of said second transistor, and a second terminal connected to the second terminal of said third transistor; and a feedback connection coupling the second terminal of said second transistor with the inverting input of said second operational amplifier.

* * * * *